US010584861B2

(12) United States Patent
Farley et al.

(10) Patent No.: US 10,584,861 B2
(45) Date of Patent: Mar. 10, 2020

(54) APPARATUS AND METHOD OF AUTOMATED ASSEMBLY OF AN LED LAMP

(71) Applicant: Ledvance LLC, Wilmington, MA (US)

(72) Inventors: Steven C. Farley, Derry, NH (US); Brian G. Lariviere, Hampstead, NH (US); Thomas J. Spehalski, Emporium, PA (US); Thomas James Peles, Ridgway, PA (US); Valeriy Zolotykh, Abington, MA (US); Nilesh Patel, Andover, MA (US)

(73) Assignee: LEDVANCE LLC, Wilmington, MA (US)

( * ) Notice: Subject to any disclaimer, the term of this patent is extended or adjusted under 35 U.S.C. 154(b) by 589 days.

(21) Appl. No.: 15/411,163

(22) Filed: Jan. 20, 2017

(65) Prior Publication Data

US 2018/0209629 A1 Jul. 26, 2018

(51) Int. Cl.

| | |
|---|---|
| ***F21V 23/06*** | (2006.01) |
| ***F21K 9/238*** | (2016.01) |
| ***F21K 9/235*** | (2016.01) |
| ***F21K 9/90*** | (2016.01) |
| ***F21V 23/00*** | (2015.01) |
| ***F21Y 115/10*** | (2016.01) |

(52) U.S. Cl.

CPC ..... *F21V 23/06* (2013.01); *F21K 9/235* (2016.08); *F21K 9/238* (2016.08); *F21K 9/90* (2013.01); *F21V 23/001* (2013.01); *F21Y 2115/10* (2016.08)

(58) Field of Classification Search

CPC ..... F21V 23/001; F21V 23/06; F21K 9/235; F21K 9/238; F21K 9/90

See application file for complete search history.

(56) References Cited

U.S. PATENT DOCUMENTS

2014/0246978 A1* 9/2014 Athalye ..... H01R 13/6658 315/119

* cited by examiner

*Primary Examiner* — Thomas M Sember

(74) *Attorney, Agent, or Firm* — Tutunjian & Bietetto, PC

(57) ABSTRACT

An apparatus for an LED lamp includes an optic device. At least one light engine wire is connected to the optic device and mounted at least partially external to the optic device. A base is engaged with the optic device. A driver is contained within the base. At least one contact is mounted on the driver in electrical communication with the driver, wherein the at least one contact is in non-engaged contact with the at least one light engine wire.

18 Claims, 5 Drawing Sheets

APPARATUS AND METHOD OF AUTOMATED ASSEMBLY OF AN LED LAMP

FIELD

The present invention generally relates to LED lamps and, more particularly, is related to a lamp design that permits high speed automated assembly.

BACKGROUND

LED drivers (also known as LED power supplies) are similar to ballasts for fluorescent lamps or transformers for low-voltage bulbs. The LED drivers provide LEDs with the electricity required to function and perform at their best. LEDs run on low voltage and direct current, but are powered by higher voltage alternating current sources. LEDs require drivers to convert higher voltage, alternating current to low voltage, direct current and to keep the voltage and current flowing through an LED circuit at a controlled, rated level. All LED light bulbs require a driver.

Connecting the LED driver to the LED light engine is typically a manual activity that involves twisting conductors from the LED driver to conductors connected to the LED light engine, sometimes soldering them together. Manual connection of the driver to the light engine is cumbersome and creates manufacturing expense, particularly for large scale production. A better option for connecting the driver and light engine is needed.

Thus, a heretofore unaddressed need exists in the industry to address the aforementioned deficiencies and inadequacies.

SUMMARY

In light of the foregoing, the present invention generally relates to an apparatus and method of automated assembly of an LED lamp. Generally, with reference to the structure of the apparatus, the apparatus for an LED lamp includes an optic device. At least one light engine wire is connected to the optic device and mounted at least partially external to the optic device. A base is engaged with the optic device. A driver is contained within the base. At least one contact is mounted on the driver in electrical communication with the driver, wherein at least one contact is in non-engaged contact with the at least one light engine wire.

Generally, the method for providing automated assembly of an LED lamp contains the step of: engaging an optic device having at least one light engine wire external to the optic device with a base, wherein engaging the optic device with the base automatically places the light engine wire in non-engaged contact with at least one contact mounted on a driver contained within the base.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

The present invention can be better understood with reference to the following drawings. The components of the drawing are not necessarily to scale, emphasis instead being placed upon clearly illustrating the principles of the present invention. Moreover, in the drawings, like referenced numbers designate corresponding parts throughout the several views.

DETAILED DESCRIPTION

The present invention generally relates to LED lamps and, more particularly, is related to a lamp design that permits automated assembly. It should be noted that, while the following provides a series of examples of the LED lamp and its components other configurations may be utilized without departing from the scope of the claims.

Figure 1:
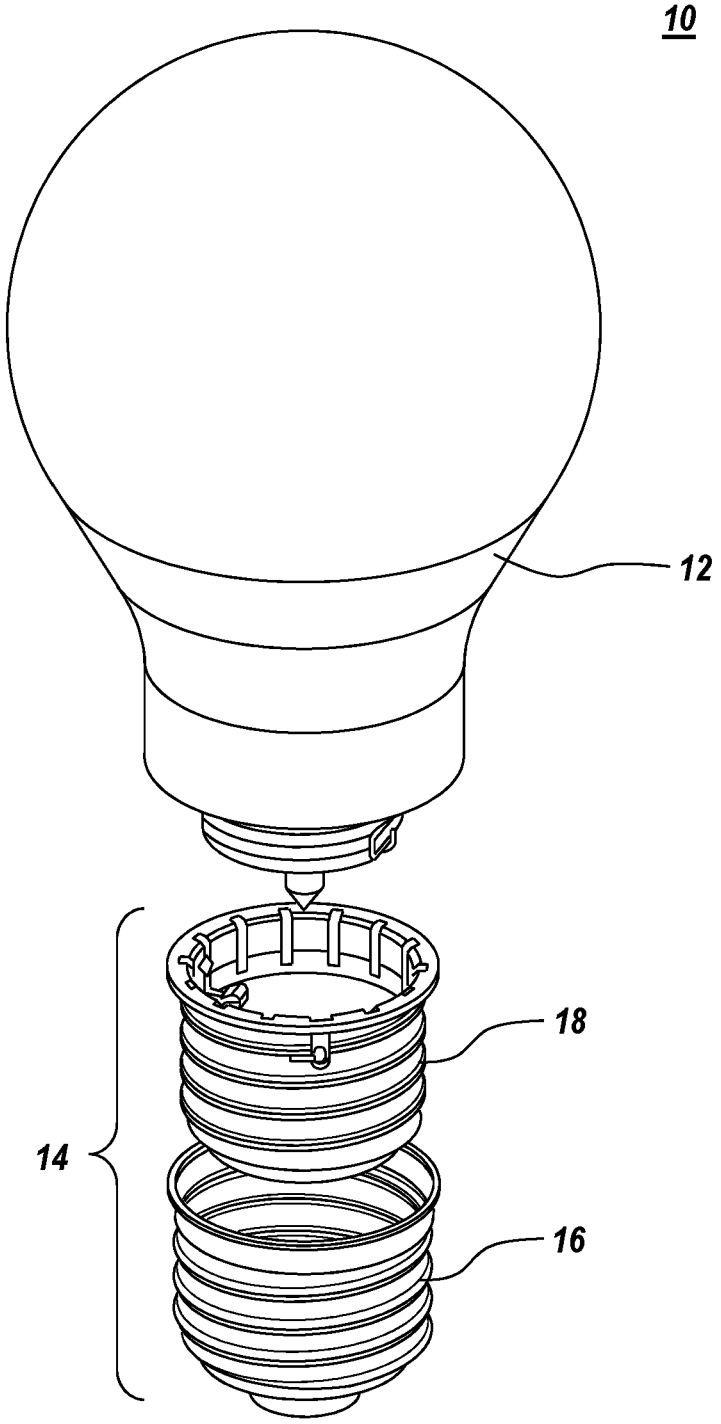
FIG. 1 is an exploded perspective view of an LED lamp, in accordance with a first exemplary embodiment of the present disclosure.

FIG. 1 is an exploded perspective view of an LED lamp 10, in accordance with a first exemplary embodiment of the present disclosure. The LED lamp 10 includes an optic device 12. The optic device 12 may and do take the form of any type of known lighting device, including but not limited to a lamp, a light engine, a module, and so forth. The optic device 12 may include a combination of a light engine and a bulb. A base 14 is engaged with the optic device 12. The base 14 may include an electrically conductive exterior 16, an electrically insulative interior 18, and a driver 20 (not shown). The electrically conductive exterior 16 and the electrically insulative interior 18 may be joined together, for instance, by mechanical, including threading the electrically insulative interior 18 into the electrically conductive exterior 16, adhesive, or other means known to those having ordinary skill in the art. The driver 20 may be contained within the electrically insulative interior 18.

Figure 2:
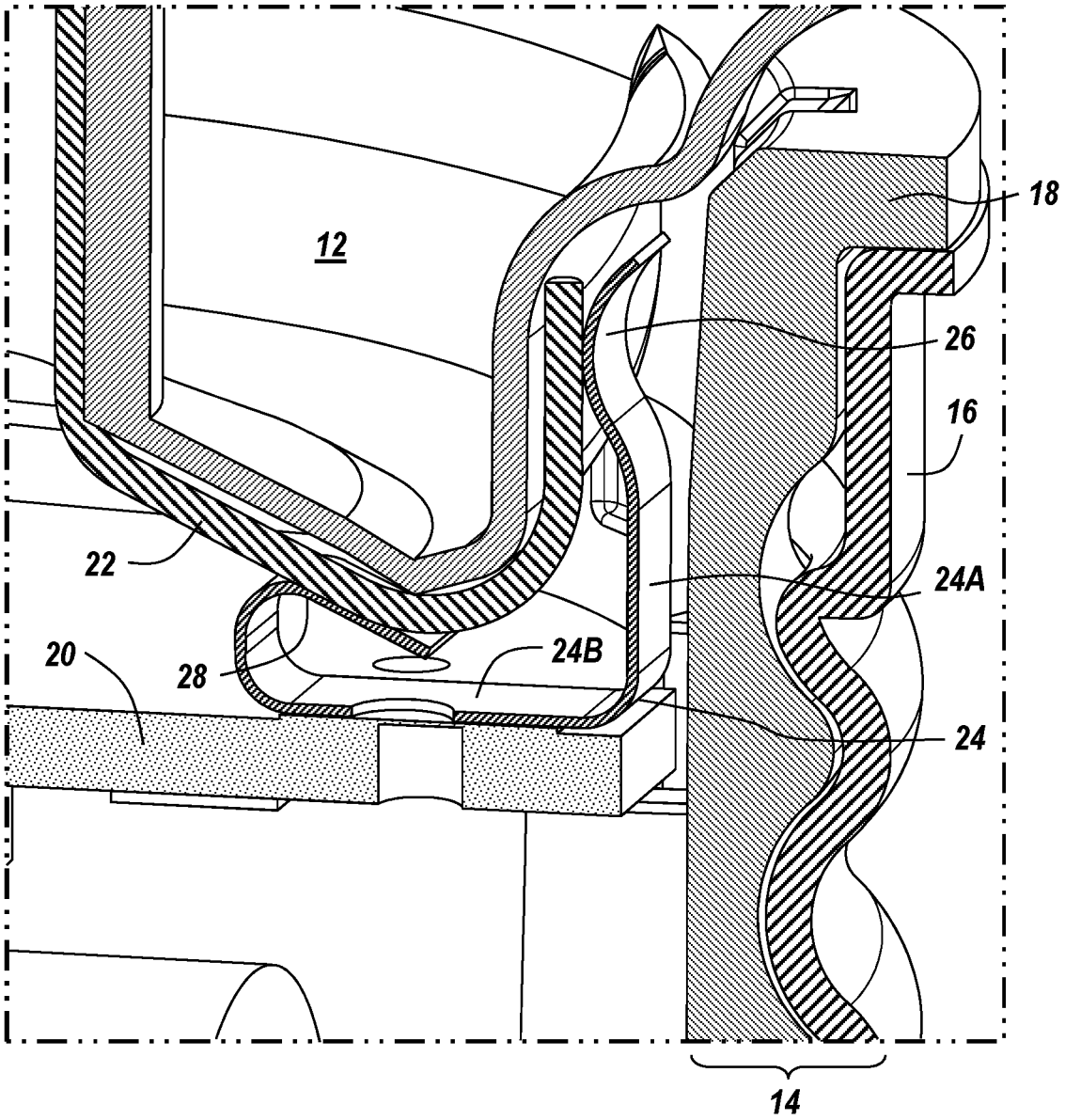
FIG. 2 is a cutaway perspective view of a portion of the LED lamp illustrated in FIG. 1, in accordance with a first exemplary embodiment of the present disclosure.

FIG. 2 is a cutaway perspective view of a portion of the LED lamp 10 illustrated in FIG. 1, in accordance with a first exemplary embodiment of the present disclosure. At least one light engine wire 22 is connected to the optic device 12 and mounted at least partially external to the optic device 12. The driver 20 is contained within the base 14. At least one contact 24 is mounted on the driver 20 in electrical communication with the driver 20, wherein the at least one contact 24 is in non-engaged contact with the at least one light engine wire 22.

By orientating the light engine wire 22 and the contact 24 in a manner that causes the two elements to be put in electrical contact when the optic device 12 is engaged with the base 14, assembly of the LED lamp is simplified and more easily automated. As can be seen in FIG. 2, one embodiment for causing this connection includes creating an L-shaped contact 24 and bending the light engine wire 22 into a substantially L-shape that conforms to an exterior portion of the optic device 12. Providing both elements with comparable shapes enhances the engagement of the elements in at least one location.

As illustrated in FIG. 2, the at least one L-shaped contact 24 may include a vertical element 24A having a first biased protrusion 26 and a horizontal element 24B having a second biased protrusion 28. The horizontal element 24B may be the portion of the contact 24 that connects to the driver 20. The first biased protrusion 26 and the second biased protrusion 28 may both be biased toward the optic device 12 and, more specifically, the light engine wire 22. Biasing portions of the contact 24 enhances the reliability of electrical contact between the contact 24 and the light engine wire 22 by allowing variance in the dimensions of the LED lamp 10 elements without diminishing quality of the electrical connection. Further, it can be seen that electrical contact is established between the contact 24 and the light engine wire 22 without having to engage the two elements directly. Engaging the two elements requires time and slows production.

Figure 3:
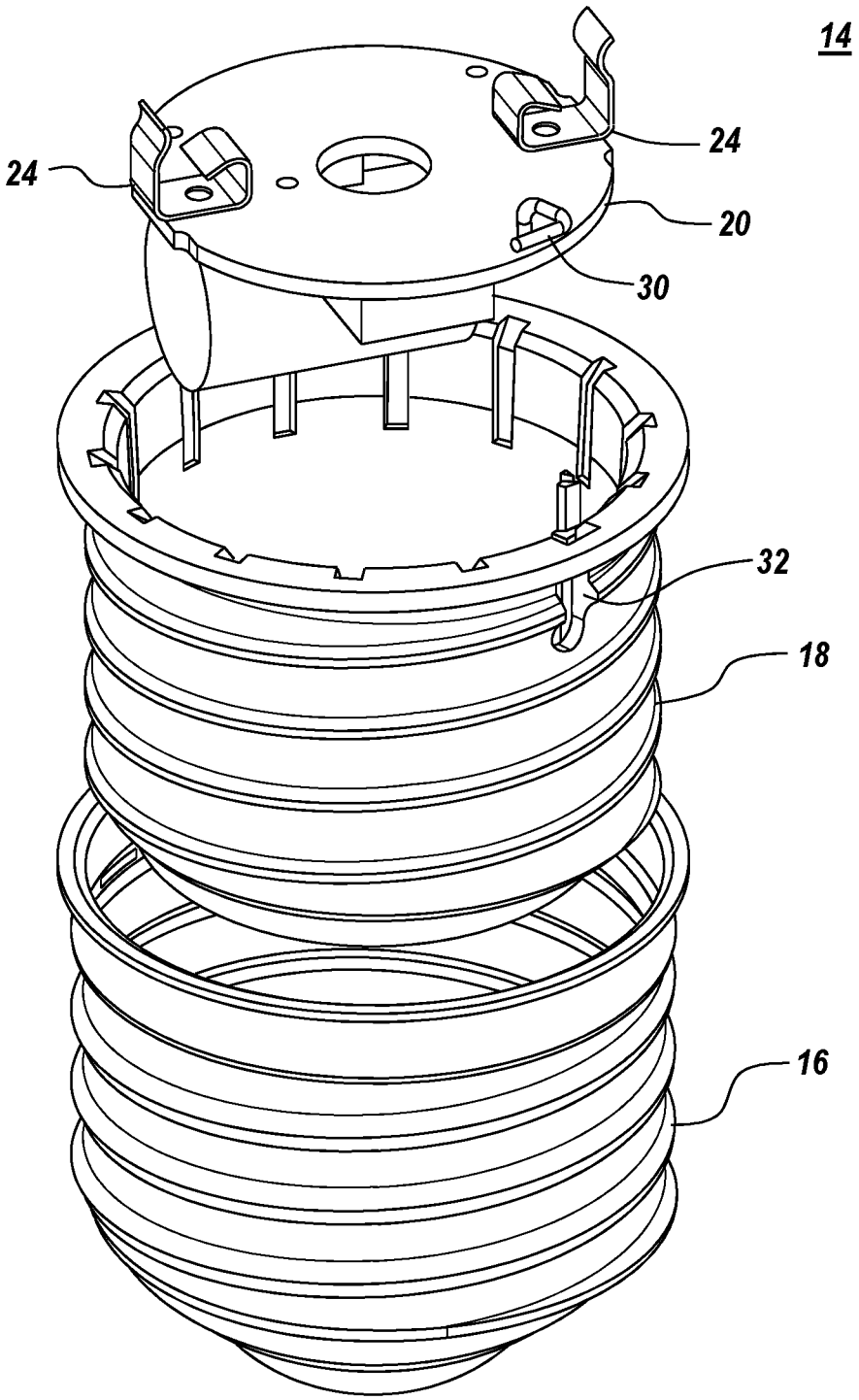
FIG. 3 is an exploded perspective view of the base illustrated in FIG. 1, in accordance with a first exemplary embodiment of the present disclosure.

FIG. 3 is an exploded perspective view of the base 14 illustrated in FIG. 1, in accordance with a first exemplary embodiment of the present disclosure. As illustrated, the base 12 includes the electrically conductive exterior 16, the electrically insulative interior 18, and the driver 20. The driver 20 may include two contacts 24. The optic device 12 may have one light engine wire 22 for each contact 24. The driver 20 may also have a base connection element 30. When assembled, the base connection element 30 extends through an aperture 32 in the electrically insulative interior 18 to provide an electrical connection between the driver 20 and the electrically conductive exterior 16.

Figure 4:
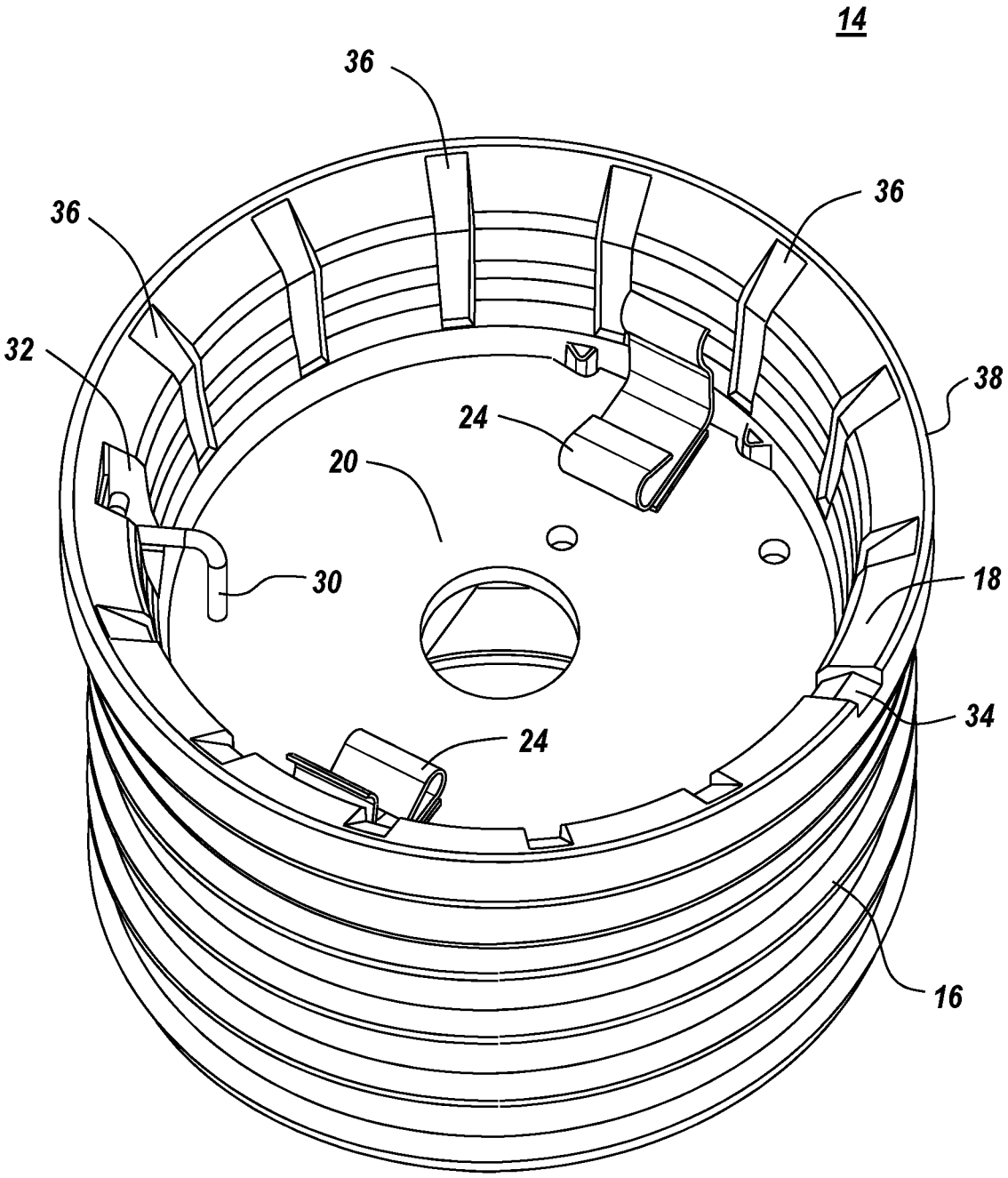
FIG. 4 is a perspective view of the base illustrated in FIG. 3, in accordance with a first exemplary embodiment of the present disclosure.

FIG. 4 is a perspective view of the base 14 illustrated in FIG. 3, in accordance with a first exemplary embodiment of the present disclosure. As illustrated, the base 12 includes the electrically conductive exterior 16, the electrically insulative interior 18, and the driver 20. The driver 20 may include two contacts 24. The optic device 12 may have one light engine wire 22 for each contact 24. The driver 20 may also have a base connection element 30. The base connection element 30 extends through an aperture 32 in the electrically insulative interior 18 to provide an electrical connection between the driver 20 and the electrically conductive exterior 16.

The electrically insulative interior 18 may also include an alignment notch 34. As can be seen in FIG. 4, the electrically insulative interior 18 may have a series of vertical notches 36 along an inner side of the interior 18. However, the alignment notch 34 is the only notch that extends through a top lip 38 of the electrically insulative interior 18. Locating the alignment notch 34 allows mechanical or visual alignment between the base 14 and the optic device 12 to orient the contacts 24 relative to the light engine wires 22 and provide a proper connection when the optic device 12 is engaged with the base 14.

Figure 5:
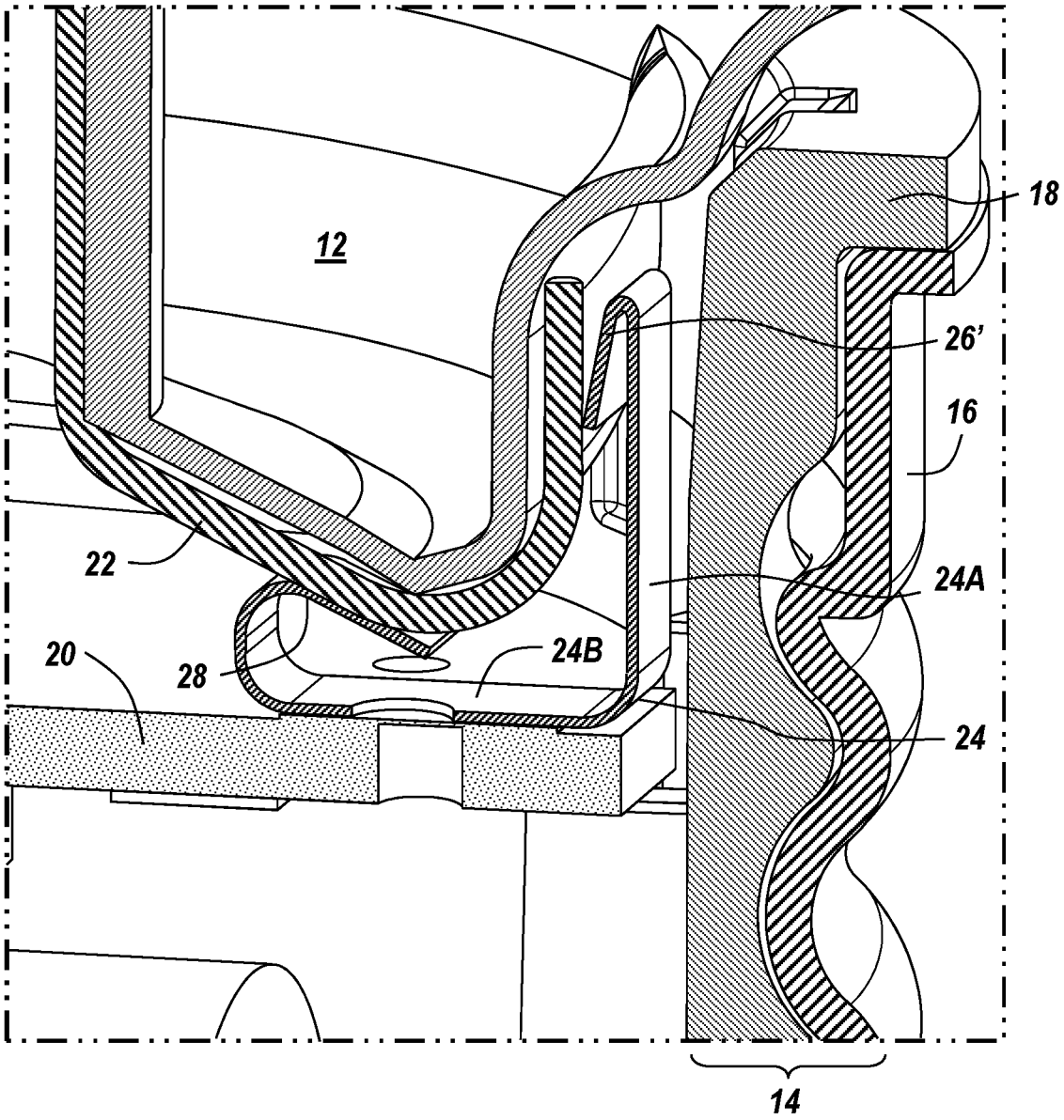
FIG. 5 is a cutaway perspective view of a portion of the LED lamp illustrated in FIG. 1, in accordance with a second exemplary embodiment of the present disclosure.

FIG. 5 is a cutaway perspective view of a portion of the LED lamp 10 illustrated in FIG. 1, in accordance with a second exemplary embodiment of the present disclosure. FIG. 5 is very similar to FIG. 2, with a comparable optic device 12, base 14 (including the conductive exterior 16 and insulative interior 18), the driver 20, and at least one light engine wire 22. The variation in this embodiment is the form of the at least one contact 24 in non-engaged contact with the at least one light engine wire 22.

The at least one L-shaped contact 24 includes a vertical element 24A having a first biased protrusion 26' and a horizontal element 24B having a second biased protrusion 28. The first biased protrusion 26' in the second exemplary embodiment differs from the first biased protrusion 26 (as shown in FIG. 2) in shape. Both shapes provide a means for biasing the L-shaped contact 24 into electrical contact with the light engine wire 22, but different shapes may offer different benefits, including reliability making and maintaining electrical contact despite the lack of engagement with the light engine wire 22. Other variations in the biasing portions of the contact 24 that permit reliable non-engaged electrical contact between the contact 24 and the light engine wire 22 are considered to be within the scope of the present disclosure.

The present disclosure also includes a method for assembling the LED lamp 10. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

The method of assembling the LED lamp 10 includes engaging an optic device 12 having at least one light engine wire 22 external to the optic device 12 with a base 14, wherein engaging the optic device 12 with the base 14 automatically places the light engine wire 22 in non-engaged contact with at least one contact 24 mounted on a driver 20 contained within the base 14.

The method may further include aligning the optic device 12 with the base 14 for engagement using an alignment notch 34 for mechanical or visual alignment of the optic device 12 and the base 14 prior to the step of engaging. The LED lamp 10 described in the method may include any or all of the structural components described relative to the LED lamp 10 and illustrated in the attached figures. The method may include pre-arranging the light engine wire 22 in an L-shape to conform to an exterior of the optic device 12 and/or reflect the shape of the contact 24.

It should be emphasized that the above described embodiments of the present invention are merely some possible examples of implementations, set forth for a clear understanding of the principles of the invention. Many variations and modifications may be made to the above described embodiments of the invention without departing substantially from the spirit and principles of the invention. All such modifications and variations are intended to be included herein within the scope of this disclosure and the present invention, and protected by the following claims.

The following is claimed:

1. An apparatus for an LED lamp, comprising: an optic device; at least one light engine wire connected to the optic device is mounted at least partially external to the optic device; a base engaged with the optic device; a driver contained within the base; at least one contact mounted on the driver in electrical communication with the driver, wherein the at least one contact further comprises at least one L-shaped contact and the at least one contact is in non-engaged contact with the at least one light engine wire.

2. The apparatus of claim 1, wherein the at least one light engine wire has an L-shaped portion that substantially conforms to an exterior portion of the optic device.

3. The apparatus of claim 1, wherein the optic device comprises a light engine integral with a bulb.

4. The apparatus of claim 1, wherein the base comprises an electrically conductive exterior, an electrically insulative interior, wherein the driver is contained within the electrically insulative interior, and at least one electrical connection from the electrically conductive exterior to the driver.

5. The apparatus of claim 1, wherein the at least one L-shaped contact comprises: a vertical element having a first biased protrusion; and a horizontal element having a second biased protrusion.

6. The apparatus of claim 5, wherein the first biased protrusion and the second biased protrusion are both biased toward the optic device.

7. The apparatus of claim 5, wherein at least one of the first biased protrusion and the second biased protrusion form the non-engaged contact with the at least one light engine wire.

8. The apparatus of claim 1, wherein the base further comprises an alignment notch whereby the alignment notch is usable for mechanical or visual alignment of the optic device and the base.

9. A method of assembling an LED lamp, the method comprising the step of engaging an optic device having at least one light engine wire external to the optic device with a base, wherein engaging the optic device with the base automatically places the light engine wire in non-engaged contact with at least one contact mounted on a driver contained within the base, wherein the at least one contact further comprises at least one L-shaped contact.

10. The method of claim 9, further comprising the step of aligning the optic device with the base for engagement using an alignment notch for mechanical or visual alignment of the optic device and the base prior to the step of engaging.

11. The method of claim 9, further comprising prearranging the at least one light engine wire to include an L-shaped portion that substantially conforms to an exterior portion of the optic device.

12. The method of claim 9, wherein the optic device comprises a light engine integral with a bulb.

13. The method of claim 9, wherein the base comprises an electrically conductive exterior, an electrically insulative interior, wherein the driver is contained within the electrically insulative interior, and at least one electrical connection from the electrically conductive exterior to the driver.

14. The apparatus of claim 9, wherein the at least one L-shaped contact comprises: a vertical element having a first biased protrusion; and a horizontal element having a second biased protrusion.

15. The method of claim 14, further comprising biasing at least one of the vertical element and the horizontal element into electrical contact with the light engine wire.

16. The method of claim 14, wherein at least one of the first biased protrusion and the second biased protrusion form the non-engaged contact with the at least one light engine wire.

17. A system for connecting at least one light engine wire of a light engine to at least one contact integral with a driver inside a base, the system comprising: contacting means for causing the at least one light engine wire and the at least one contact to abut by engaging the light engine with the base and without manually engaging the at least one light engine with the at least one contact, wherein the at least one contact comprises at least one L-shaped contact.

18. The system of claim 17, wherein the at least one contact is biased against the at least one light engine wire.

* * * * *